United States Patent [19]

Satoh et al.

[11] Patent Number: 4,586,705

[45] Date of Patent: May 6, 1986

[54] AUTOMATIC PAPER FEEDING DEVICE FOR A FACSIMILE EQUIPMENT OR THE LIKE APPARATUS

[75] Inventors: Jinichi Satoh; Hideya Ino, both of Chigasaki; Masaaki Ishikawa, Hino; Michihisa Iguchi, Tama, all of Japan

[73] Assignees: Tokyo Shibaura Denki Kabushiki Kaisha, Tokyo, Japan; International Business Machines Corp., Armonk, N.Y.

[21] Appl. No.: 744,908

[22] Filed: Jun. 17, 1985

Related U.S. Application Data

[63] Continuation of Ser. No. 479,352, Mar. 28, 1983, abandoned.

[30] Foreign Application Priority Data

Mar. 26, 1982 [JP] Japan ..... 57-48715

[51] Int. Cl.[4] ..... B65H 3/52

[52] U.S. Cl. ..... 271/122; 271/125

[58] Field of Search ..... 271/121, 122, 125, 165, 271/166, 167

[56] References Cited

U.S. PATENT DOCUMENTS

| | | | |
|---|---|---|---|
| 3,210,073 | 10/1965 | Godlewski | 271/125 |
| 3,239,213 | 3/1966 | Griswold | 271/35 |
| 3,771,783 | 11/1973 | McInerny | 271/125 |
| 3,857,559 | 12/1974 | McInerny | 271/122 |
| 4,114,870 | 9/1978 | Di Blasio | 271/122 X |
| 4,208,046 | 6/1980 | Shimizu | 271/122 |
| 4,316,606 | 2/1982 | Buys | 271/122 X |

FOREIGN PATENT DOCUMENTS 42-1211 1/1967 Japan .

*Primary Examiner*—Richard A. Schracher

*Attorney, Agent, or Firm*—Finnegan, Henderson, Farabow, Garrett & Dunner

[57] ABSTRACT

An improved automatic paper feeding device for a facsimile equipment or the like apparatus is disclosed which includes a feeding roller (3) disposed below the feeding end part of an inclined paper feeding board (2) and a reversing roller (7) located above the feeding roller (2) in a line contact relation to be rotated in the opposite direction to that of drawing of papers from the paper feeding board (2), the reversing roller being rotatably supported at the free end part of side plate members (20) adapted to turn about a support shaft (21). A connecting line between the shafts (4,8) of the feeding roller (7) and the reversing roller (7) extends substantially at a right angle relative to a connecting line between the shaft (8) of the reversing roller (7) and the support shaft (21) for the side plate members (20). The direction of tension given by an endless belt (36) for rotating the reversing roller (7) is selectively determined to extend substantially at a right angle relative to the connecting line between the shafts (4,8) of the feeding roller (3) and the reversing roller (7) whereby contact pressure to be exerted on the feeding roller (3) by the tension of the endless belt (36) via the reversing roller (7) becomes practically zero.

Thus it is assured that the device is operated without any extra contact pressure active on the feeding roller while fluctuation in contact force is minimized.

6 Claims, 4 Drawing Figures

AUTOMATIC PAPER FEEDING DEVICE FOR A FACSIMILE EQUIPMENT OR THE LIKE APPARATUS

This application is a continuation of application Ser. No. 479,352, filed Mar. 28, 1983, now abandoned.

BACKGROUND OF THE INVENTION

1. Field of the Invention:

The present invention relates to an improved automatic paper feeding device for a facsimile equipment or the like apparatus and more particularly to an automatic paper feeding apparatus in which optimum paper feeding is assured without any influence of fluctuation in contact pressure between a feeding roller and a reversing roller.

2. Description of the Prior Art:

A hitherto known automatic feeding device of the type including a feeding roller adapted to rotate in the direction of feeding of papers and a reversing roller adapted to rotate in the opposite direction to that of feeding of papers in a line contact relation with respect to the feeding roller so that papers are drawn one by one under cooperation between both the rollers is generally arranged such that a single endless timing belt is extended round pulleys on both the rollers so as to rotate them simultaneously.

To facilitate understanding of the invention it will be helpful that the conventional device of the above mentioned type will be briefly described.

FIG. 1 schematically illustrates a typical conventional automatic paper feeding device for a facsimile equipment or the like by way of a vertical sectional view. Specifically, a paper feeding board (manuscript holding board) 2 is fixedly secured to side walls 2 at a predetermined inclination angle relative to a horizontal plane and a feeding roller 3 is rotatably mounted on a shaft 4 which extends between both the side walls 1. The feeding roller 3 is made of elastomeric material such as neoprene sponge rubber or the like material which has a high frictional coefficient $\mu 1$ when it is in use in cooperation with a sheet of paper MS such as manuscript or the like. Further, a pair of levers 5 are held pivotally about a shaft 6 so that a reversing roller 7 is rotatably mounted on a shaft 8 at the free end part of said levers 5. The reversing roller 7 is made of another elastomeric material such as polyurethane rubber or the like material which has a frictional coefficient $\mu 2$ appreciably lower than the first mentioned one $\mu 1$. It should be noted that papers in the form of a sheet (hereinafter referred to simply as paper) a frictional coefficient $\mu 3$ when they are brought in contact with one another, said frictional coefficient $\mu 3$ being lower than the last mentioned one $\mu 2$ and therefore a correlation is established among them as represented by an inequality ($\mu 1 > \mu 2 > \mu 3$). The lowermost end part 5*a* of the lever 5 is adapted to abut against the foremost end of a screw 10 which extends through a stay 9 fixedly secured to the side walls 1 so that contact pressure between both the rollers 3 and 7 can adjusted by rotating the screw 10. A shaft $\mathbf{11}_a$ of a driving motor 11, the shaft 4 of the feeding roller 3 and the shaft 8 of the reversing roller 7 include pulleys 13, 14 and 15 fixedly mounted thereon respectively and an endless timing belt (driving belt) 16 is extended round each of the pulleys 13, 14 and 15 so that the rollers 3 and 7 are rotated in the same direction as identified with an arrow mark A.

The arrangement as described above makes it possible to draw out papers one by one from the bottom of the layer of sheet papers MS placed on the paper feeding board 2 while the feeding roller 3 cooperates with the reversing roller 7.

It is found with respect to the illustrated conventional device that due to tension given by the endless timing belt 16 the levers 5 are caused to turn in the counterclockwise direction to approach closer to the roller 3, resulting in increased contact pressure between both the rollers 3 and 7, said increased contact pressure being varied as the endless timing belt 16 is circulatively operated. When the contact pressure increases in excess of a properly determined level, there is a fear of causing a trouble that the paper MS is inhibited from entering in the contact area between the feeding roller 3 and the reversing roller 7 or it is fed thereinto in the wrong manner. In the extreme case the paper may damaged or injured.

Further it is found with respect to the conventional automatic paper feeding device that as it continues to be operated contact pressure between the rollers is gradually reduced due to an occurrence of wearing of the rollers and moreover proper contact pressure fails to be maintained because of decrease in diameter of the rollers when environmental conditions change, particularly when it becomes cool. When contact force decreases, the rollers have a reduced capability of separating the papers one from another and therefore it happens that the plural number of papers are fed simultaneously.

SUMMARY OF THE INVENTION

Hence, the present invention is intended to obviate the drawbacks as mentioned above with respect to the conventional automatic paper feeding device.

It is an object of the present invention to provide an improved automatic paper feeding device for a facsimile equipment or the like apparatus which is constructed such that operation is performed without any extra contact pressure to be exerted on a feeding roller via a reversing roller while fluctuation in contact pressure is minimized.

It is another object of the present invention to provide an automatic paper feeding device for a facsimile equipment or the like apparatus which assures that any excessively increased contact pressure between the feeding roller and the reversing roller can be effectively absorbed whereby paper feeding is practiced in a constant timing relation at all time without any fear of causing wrong feeding and damaging or injuring papers to be fed.

In a preferred embodiment of the invention the automatic paper feeding device includes a pair of side plate members adapted to turn about a shaft (hereinafter referred to as a support shaft) extending across the side walls of the device so that a reversing roller is rotatably supported at the free end part of the side plate members. Further, a paper guide, a stay and other members are attached to the side plate members. The side plate members are adapted to turn about the support shaft in the counterclockwise direction due to gravity force developed by the whole dead weight of the side plate member assembly including the reversing roller, the paper guide and the stay until the reversing roller is brought in pressure contact with a feeding roller disposed below it.

To rotate the reversing roller a motor is fixedly mounted at a predetermined position on the side wall of the device and a pulley is fixed onto the shaft of the motor. A pulley is firmly fitted onto the shaft of the reversing roller, whereas a pulley is rotatably mounted on the support shaft. An endless timing belt is extended around the pulley of the motor and the pulley on the support shaft and another endless timing belt is extended round the pulley on the support shaft and the pulley of the reversing roller whereby rotation of the motor is transmitted to the reversing roller via the pulley on the support shaft with the aid of the timing belt.

In the preferred embodiment the support shaft is selectively located in such a way that a connecting line between shaft of the reversing roller and the support shaft for the side plate members extends substantially at a right angle relative to a connecting line between the shafts of the reversing roller and the feeding roller. The arrangement of the support shaft as described above assures that rotating force transmitted to the reversing roller by the timing belt has no effect on contact pressure between the reversing roller and the feeding roller. Thus, contact pressure is dependent only on the whole weight of the side plate member assembly including the reversing roller and others and therefore optimum automatic feeding is assured by properly determining the aforesaid whole weight of the side plate member assembly.

Other objects, features and advantages of the invention will be apparent from the reading of the following description made in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in detail hereunder with reference to FIGS. 2 and 3.

Figure 1:
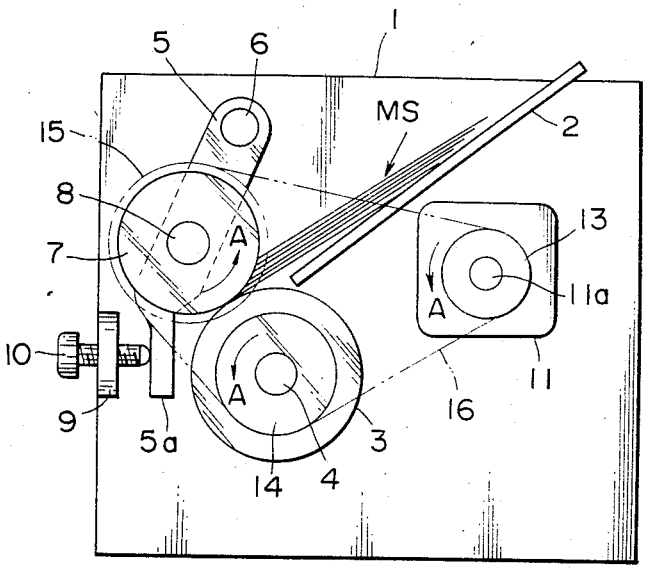
FIG.1 (PRIOR ART)
FIG. 1 is a schematic vertical sectional view of a conventional automatic paper feeding device.
Figure 2:
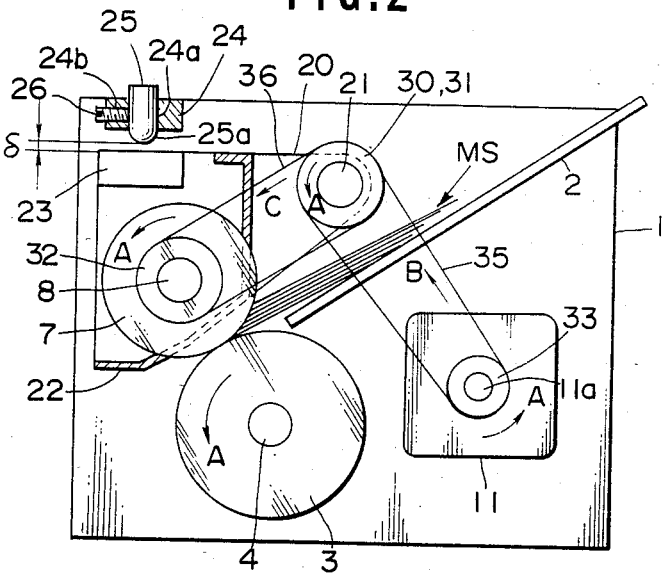
FIG. 2 is a schematic vertical sectional view of an automatic paper feeding device in accordance with an embodiment of the present invention.

Referring first to FIG. 2, a feeding roller 3 is rotatably mounted on a shaft 4 extending between side walls 1, said shaft 4 being adapted to be rotated by means of a motor (not shown) in the counterclockwise direction as identified with an arrow mark A in the drawing. It should be noted that the same or similar parts in the drawing are represented by the same reference numerals as those in FIG. 1.

A pair of side plate members 20 are mounted turnably about a support shaft 21 which is rotatably supported by the side walls 1. On the support shaft 21 are fixedly mounted pulleys 30 and 31 which are located thereon in a side-by-side relation. A reversing roller 7 is fixedly mounted on a shaft 8 which is rotatably supported by the side plate members 20, said shaft 8 including a pulley 32 fixedly mounted thereon. Further, the side plate members 20 are provided with a paper guide 22 and a stay 23. The arrangement of the side plate members 20 including the reversing roller 7, the paper guide 22 and the stay 23 in that way causes them to turn about the support shaft 21 in the counterclockwise direction under the influence of their dead weight whereby the reversing roller 7 is brought in pressure contact with the feeding roller 3. Thus, by properly selecting thickness, material and other factors of the side plate members 20, the reversing roller 7, the paper guide 22 and the stay 23 a correctly determined contact pressure is attained between the reversing roller 7 and the feeding roller 3.

For instance, a pulse motor is employed for a driving motor 11 which is attached to the side wall 1 at a predetermined position and of which driving shaft $11_a$ includes a pulley 33 fixedly mounted thereon. An endless timing belt 35 is movably extended around the pulley 30 on the support shaft 21 and the pulley 33 on the driving shaft $11_a$ of the motor 11, whereas another endless timing belt 36 is extended round the pulley 31 on the support shaft 21 and the pulley 32 on the shaft 8 of the reversing roller 7.

As the motor 11 rotates in the direction as identified with an arrow mark A, the endless timing belt 35 is caused to follow in the direction as identified with an arrow mark B so that the pulley 30 is rotated in the direction as identified with an arrow mark A. Since the pulley 31 is rotated together with the pulley 30 in the same direction, the endless timing belt 36 moves in the direction as identified with an arrow mark C so that the pulley 32, i.e., the reversing roller 7 is rotated in the direction A. Thus, rotating power of the motor 11 is transmitted to the reversing roller 7 by way of the support shaft 21 in the above-described manner.

Incidentally, tension of the endless timing belt 36 is directed substantially in parallel to the connecting line extending between the shaft 8 and the support shaft 21. Hence, by selectively locating the position of the support shaft 21 in such manner that the connecting line extending between the shaft 8 and the support shaft 21 is directed at a right angle relative to the connecting line extending between the both shafts 8 and 4, contact pressure exerted on the feeding roller 3 by the reversing roller 7 under the influence of tension given by the endless timing belt 36 becomes zero. The support shaft 21 should be preferably located at the position where the above-mentioned operative condition is fulfilled. Once this operative condition has been established, there occurs no fluctuation in contact pressure between the reversing roller 7 and the feeding roller 3 due to the influence of tension of the timing belt.

It should be of course understood that the present invention should not be limited only to the above operative condition but it is permissible to allow some fluctuation in contact pressure between the reversing roller 7 and the feeding roller 3 under the influence of tension of the timing belt 36 as far as such fluctuation has substantially no effect on correct paper feeding and therefore it is required that the connecting line between the shaft 8 and the support shaft 21 extends strictly at a right angle relative to the connecting line between both the shafts 8 and 4, i.e., the angular relation between both the connecting lines may be varied within the extent of tolerable fluctuation in contact pressure.

Further, a stay 24 is fixedly secured to the side walls 1 at the uppermost end part thereof. At the position located opposite to the stay 24, and a hole $24_a$ is formed in the direction toward the stay 23. A stopper 25 is adjustably fitted into said hole $24_a$. A threaded hole $24_b$ is formed on the stay 24 at a right angle relative to the through hole $24_a$ so that a screw 26 is screwed through said threaded hole $24_b$. The screw 26 serves to firmly hold the stopper 25 at a predetermined position by thrusting the side wall surface of the stopper 25 with its foremost end part. Specifically, the stopper 25 is positioned in such a manner that a clearance between the lowermost end $25_a$ of the stopper 25 and the stay 23 amount to a predetermined value $\delta$ under the illustrated positional condition where the reversing roller 7 is brought in pressure contact with the feeding roller 3. As will be readily apparent from the drawing, this distance $\delta$ is intended to limit rotational displacement of the reversing roller 7 about the support shaft 21 in the clockwise direction, and it is determined to a suitable value within such a range that any variation in contact pressure between the reversing roller 7 and the feeding roller 3 due to their thermal expansion at the elevated temperature does not imapir self-feeding function to be assured by them.

Next, operation of the automatic paper feeding device will be described below.

As the paper MS placed on the paper feeding board 2 enters the contact area between the rollers 3 and 7 both of which are rotated in the direction A, contact pressure between both the rollers 3 and 7 increases abruptly. At this moment the side plate members 20 are caused to turn about the support shaft 21 in the clockwise direction by the distance $\delta$ whereby increased contact pressure can be absorbed. Thus, papers on the paper feeding board 2 are drawn one by one from the bottom of the layer of papers MS by means of the feeding roller 3 and they are then discharged toward the paper guide 22 through the contact area between both the rollers 3 and 7. During the drawing of the papers there occurs no fluctuation in contact pressure between the feeding roller 3 and the reversing roller 7. As a result it is assured that the feeding roller 3 delivers papers from the paper feeding board 2 to the paper guide 22 without any fear of causing wrong feeding and damaging or injuring them.

Figure 3:
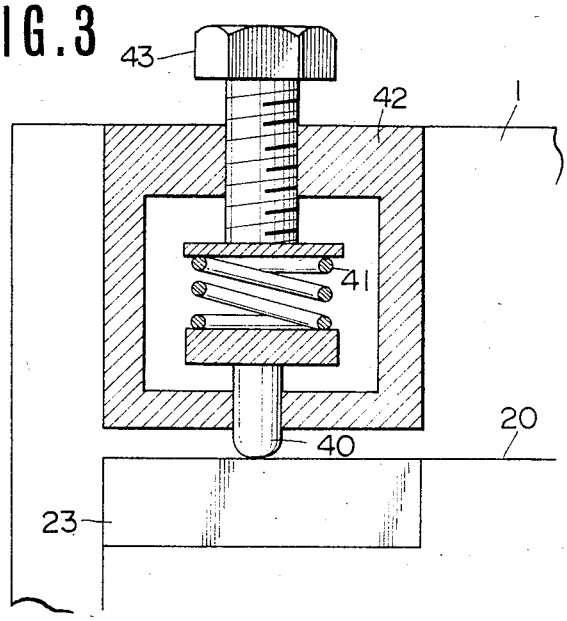
FIG. 3 is a vertical sectional view of a stopper section in the device in accordance with an embodiment modified from that in FIG. 2 in which contact pressure between a feeding roller and a reversing roller can be adjusted as required.

Next, FIG. 3 illustrates a modification of the stopper section including the stopper 25. In the drawing the same or similar parts as those in FIG. 2 are represented by the same reference numerals. Referring to FIG. 3, a stay 42 is fixedly secured to the side walls 1 at the position located opposite to the stay 23. A stopper 40 is fitted into the stay 42 and a coil spring 41 is disposed on the head part of the stopper 40 so that the latter is normally urged downward so as to allow its lowermost end part to abut against the stay 23. The stay 42 has a threaded hole formed at its upper part through which a screw 43 is screwed. By rotating the screw 43 the stopper 40 is lowered and thereby the depressing force to be exerted on the stay 23 can be adjusted as required. Thus, correct paper feeding is assured while optimum contact pressure is maintained between the feeding roller 3 and the reversing roller 7.

Figure 4:
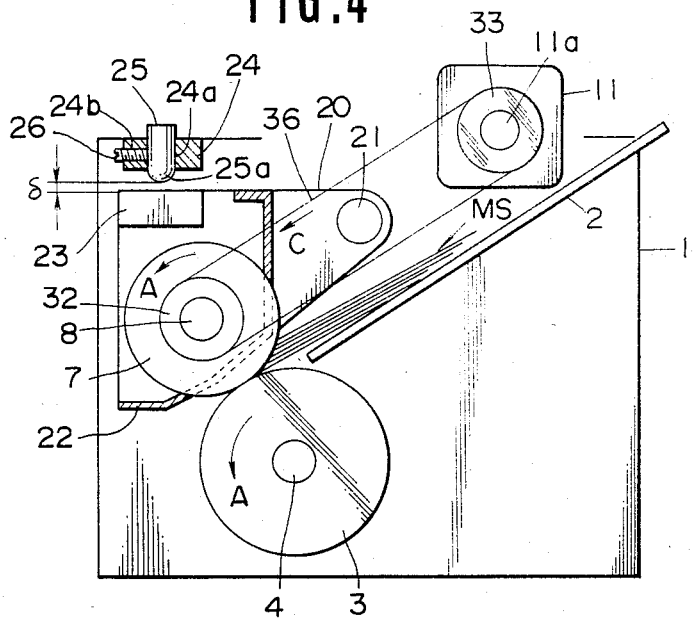
FIG. 4 is a schematic vertical sectional view of another embodiment of the automatic paper feeding in which a driving power source is disposed on a line linearly extending from the connecting line between the shaft of the reversing roller and a support shaft of a side plate.

The present invention has been described above with respect to the illustrated embodiment where rotating power of the motor 11 is transmitted to the reversing roller 7 by way of the pulley rotatably mounted on the support shaft 21 which serves as a pivotal axis for the side plates 20 on which the reversing roller 7 is rotatably supported, but it should be noted that the present invention should not be limited only to this arrangement and power transmission may be practiced in a different manner. For instance, as shown in FIG. 4 a driving power source may be disposed at a suitable position located on line linearly extending from the connecting line between the shaft of the reversing roller and the support shaft so that power is transmitted from the motor directly to the reversing roller.

What is claimed is:

1. An automatic paper feeding device comprising:

a rotational power source;

a first roller located below the lower end of an inclined paper feeding board for drawing papers in the form of a sheet placed on said paper feeding board, said first roller formed of a material having a frictional coefficient defined as U1;

a second roller located above said first roller in line contact with said first roller and forming a nip therebetween, said second roller providing an angular support for said sheets, the leading edges of said sheets assuming an arcuate shape to position the lowermost sheet between said nip, said second roller being rotated more slowly, while in the same direction as said first roller, said second roller formed of a material having a frictional coefficient defined as U2, said first and second rollers being in copperation with each other in drawing the papers one sheet after another through said nip, said sheets having a frictional coefficient defined as U3, and wherein the frictional coefficients are defined by the relationship $U1>U2>U3$;

a support shaft;

a pair of side plate members pivotally attached at one end to said support shaft, said side plate members rotatably supporting said second roller at the free end thereof;

stopper means for prohibiting said side plate members from being rotated clockwise beyond a predetermined distance; and a power transmission mechanism including a power source and at least an individual belt wherein rotating power is transmitted from said rotating power source to said second roller at an angle substantially perpendicular to the direction in which contact pressure between the first and second rollers is applied.

2. The automatic paper feeding device as defined in claim 1 wherein said support shaft of the side plate members is located a predetermined distance away from said second roller.

3. The automatic paper feeding device as defined in claim 1 wherein a gap of predetermined length is provided between said stopper means and corresponding portion of said side plate members.

4. The automatic paper feeding device as defined in claim 1 wherein said stopper means applies a varying force to said side plate members thereby restricting the movement thereof when said side plate members are rotating about said support shaft.

5. An automatic paper feeding device comprising:

an inclined paper feeding board having a planar surface for receiving sheets of paper;

a first roller and a second roller positioned adjacent said feeding board, said second roller positioned above said first roller in contact with the periphery of said first roller and forming a nip therebetween, said second roller providing an angular support for said sheets, the leading edges of said sheets assuming an arcuate shape to position the lowermost sheet between said nip, said rollers rotated about parallel axes in the same direction and cooperating to enable said first roller to draw the lowermost sheet through said nip in sequence;

a roller shaft rotatably supporting said second roller;

a support shaft positioned a predetermined distance from said second roller and at an angle from said second roller substantially perpendicular to a plane intersecting the central axes of said rollers;

a side plate assembly having a pair of side plates pivotally supported at opposite ends of said support shaft and including means on the surface of said side plates for supporting said roller shaft, said side plates thereby precluded from counterclockwise rotation by the rotational contact between said rollers, said side plate assembly further including a paper guide for directing the sheets passed between said rollers and a stay member mounted atop at least one of said side plates, the weight of said side plate assembly producing the contact pressure between said rollers;

stopper means positioned above said stay and defining a gap between said stopper means and said stay for restricting the rotational displacement of said second roller about said support shaft and for preventing more than one of said sheets from passing through said nip at a time; and transmission means including a power source and at least one belt interconnecting said power source and said second roller for transmitting rotational power to said second roller at an angle substantially perpendicular to the plane intersecting the central axes of said rollers to minimize fluctuation in contact pressure between said rollers.

6. An automatic paper feeding device comprising:

an inclined paper feeding board having a planar surface for receiving sheets of paper;

a first roller and a second roller positioned adjacent said feeding board, said second roller positioned above said first roller in contact with the periphery of said first roller and forming a nip therebetween, said rollers rotated about parallel axes in the same direction and cooperating to enable said second roller to provide an angular support for said sheets, the leading edge of said sheets assuming an arcuate shape to position the lowermost sheet between said nip, to draw one of said sheets from said feeding board at a time;

a roller shaft rotatably supporting said second roller;

a support shaft positioned a predetermined distance from said second roller and at an angle from said second roller substantially perpendicular to a plane intersecting the central axes of said rollers;

a side plate assembly having a pair of side plates pivotally supported at opposite ends of said support shaft and including means on the surface of said side plates for supporting said roller shaft, said side plates thereby precluded from counterclockwise rotation by the rotational contact between said rollers, said side plate assembly further including a paper guide for directing the sheets passed between said rollers and a stay member mounted atop at least one of said side plates, the weight of said side plate assembly producing the contact pressure between said rollers;

stopper means positioned adjacent said stay and including a spring member for applying a variable force for restricting the rotational displacement of said second roller about said support shaft and for preventing more than one sheet from passing through said nip at a time; and transmission means including a power source and at least one belt interconnecting said power source and said second roller for transmitting rotational power to said second roller at an angle substantially perpendicular to the plane intersecting the central axes of said rollers to minimize fluctuation in contact pressure between said rollers.

* * * * *